United States Patent [19]

Josephson

[11] 3,942,147

[45] Mar. 2, 1976

[54] MAGNETIC BOARDS AND COMPONENTS

[75] Inventor: Joseph Pollack Josephson, Montreal, Canada

[73] Assignee: Visual Planning Corporation, Montreal, Canada

[22] Filed: Nov. 1, 1974

[21] Appl. No.: 520,145

[30] Foreign Application Priority Data

Nov. 2, 1973 United Kingdom ..... 50971/73

[52] U.S. Cl. ..... 335/285; 335/303; 40/106.45; 40/142 A

[51] Int. Cl.[2] ..... H01F 7/20

[58] Field of Search ..... 335/285, 302, 303, 306; 40/106.45, 142 A

[56] References Cited

UNITED STATES PATENTS

| | | | |
|---|---|---|---|
| 3,191,106 | 6/1965 | Baermann | 335/303 X |
| 3,228,133 | 1/1966 | Baermann | 335/285 X |
| 3,464,134 | 9/1969 | Franklin | 40/142 A |
| 3,518,593 | 6/1970 | Hall | 335/285 |
| 3,681,857 | 8/1972 | Yardley | 40/142 A X |

*Primary Examiner*—G. Harris

*Attorney, Agent, or Firm*—McFadden, Fincham & Co.

[57] ABSTRACT

A display device comprising a display board having an outwardly facing surface, said board being of a ferromagnetic material, at least one substrate strip, said substrate strip having permanent magnetic properties comprising at least one pair of parallel spaced apart north and south magnetic poles extending in one direction thereof, at least one display unit having permanent magnetic properties comprising at least one pair of spaced apart north and south magnetic poles, said poles of said display unit being spaced apart by a distance equal to a multiple of the spacing of the north and south magnetic poles of the magnetic substrate strip. The device permits the display of indicia or characters without employing aligning means and also permits the placement of information in any desired direction.

23 Claims, 33 Drawing Figures

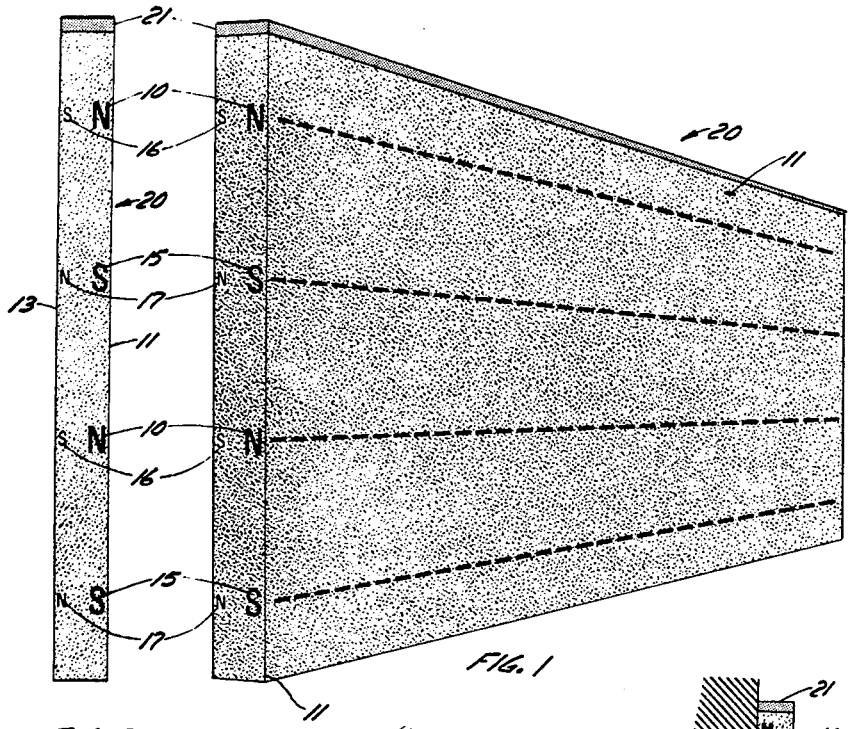
FIG. 1
FIG. 2
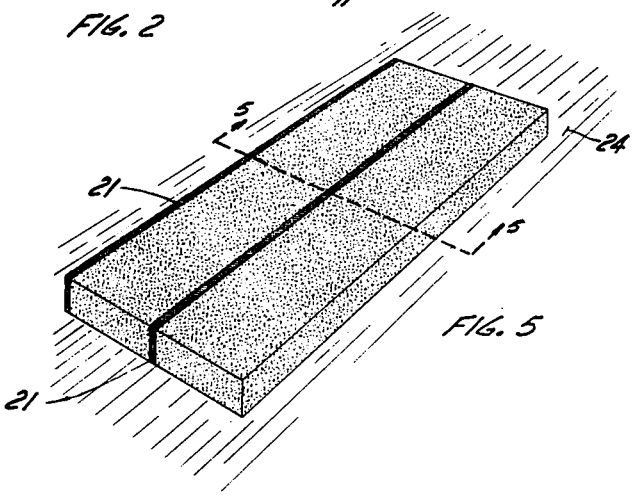
FIG. 5
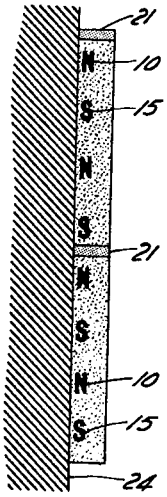
FIG. 5a

MAGNETIC BOARDS AND COMPONENTS

The invention relates to a display device and more particularly, a magnetic board display device.

Display devices are commonly used to receive interchangeable symbols such as numbers or letters of the alphabet, for use in building directories, hotel signs, restaurant menus, sales and promotion control charts, and are often used to record a particular series of items of information over a period of time.

Initially, display devices generally comprised a board or like receiving surface upon which were mounted the characters to be shown or displayed. These boards or other receiving surfaces employed a series of parallel grooves adapted to receive mating lugs on the characters or indicia to be displayed which were held therein by friction. Generally, such display devices have drawbacks in that the grooves must be precision cut entailing substantial expense and furthermore, these devices are limited in their use in that the grooves ran in one direction only. Still further, the continual insertion and removal of the characters eventually necessitated replacement of the characters or display board when they became worn and the friction was not sufficient to maintain the proper placement of the indicia.

A further development on the art has provided for a display board or surface having cooperating indicia held thereon by magnetic means. In one embodiment, the display board has alternating spaced apart lines of north and south magnetic polarity with the characters or indicia being of a ferromagnetic material. In a similar embodiment, the board or other display surface is of a ferromagnetic material with the indicia being permanent magnets. In the first instance, although the display characters or indicia are capable of self alignment due to the alternating lines of magnetic polarity, they may be mounted in one direction only on the display or receiving surface. In the second instance wherein the board is of a ferromagnetic material, in order to align the characters in a straight line, a guiding edge or like means must be employed.

According to the present invention, there is provided a display device including a display board on which information in the form of various indicia may be mounted in any direction without the necessity of employing a guiding edge; for example, horizontal, vertical or diagonally. Furthermore, no wear is associated with the components of the display device thus obviating the necessity for frequent replacement of the components.

In one aspect of the present invention, there is provided a display device comprising a display board having an outwardly facing surface, said board being of a ferromagnetic material, at least one substrate strip, said substrate strip having permanent magnetic properties comprising at least one pair of parallel spaced apart north and south magnetic poles extending in one direction thereof, at least one display unit having permanent magnetic properties comprising at least one pair of spaced apart north and south magnetic poles, said poles of said display unit being spaced apart by a distance equal to or a multiple of the spacing of the north and south magnetic poles of the magnetic substrate strip.

In greater detail, the display board or surface adapted to receive the magnetic substrate strips may be of any suitable ferromagnetic material such as, for example, iron, steel, etc. The display board may, in one embodiment, comprise a substantially rectangular board commonly employed in many industries for the purpose of displaying information. Generally, the term display board includes any board or surface upon which the magnetic substrate strips of the present invention may be placed, to this end, any suitable configuration and design may be utilized.

The magnetic substrate strips, as aforementioned, are of a permanent magnetic material and may include material such as iron, steel, various resins — in other words, any material capable of forming a permanent magnet. Generally, the magnetic substrate strips have a pair of opposed major planar faces, one of which has at least one longitudinally extending line of a north magnetic polarity and at least one longitudinally extending line of a south magnetic polarity. The opposed major face will also have spaced apart lines of north and south magnetic polarity; the south pole being substantially opposed to the north pole on said one face thereof, the south pole possessing relatively weak magnetic properties compared to the magnetic properties of the opposed north pole. Similarly, a line of north magnetic polarity will extend along the other major face opposed to the south pole and will be magnetically relatively weak compared to the strength of the south pole.

The substrate magnetic strips may comprise any number of alternating lines of polarity in pairs of the same — i.e., a single substrate strip may be defined as comprising at least one strong longitudinally extending north magnetic pole and at least one strong longitudinally extending south pole on one major face thereof. Also, substrate strips having two or more pairs of magnetic lines may be employed; it is preferred that the distance between the spaced apart lines of magnetic polarity be substantially equidistant. Preferably, the magnetic substrate strips are formed of a material which is somewhat flexible and to this end, certain resinous materials known to those skilled in the art may be employed. The dimensions including the spacing of the lines of magnetic polarity can be any conventional adapted for the end use of the device.

In one embodiment of the invention, the magnetic substrate strips may have polarity identifying means associated therewith — i.e. a single substrate strip having one line of north polarity and one line of south polarity may have an edge of the strip with polarity identifying means thereon which identify, for example, the edge proximate the strong north pole. The identifying means may be any suitable; in one embodiment, color may be employed for such purposes. The polarity identifying means comprising the color-coded strips may, for example, include a strip of a colored plastic material upon one edge of the magnetic substrate strip.

Employing the above discussed embodiment of the magnetic substrate strip, a plurality of such substrate strips may be juxtaposed to each other in many different relationships. Thus, for example, one substrate strip may be placed on top of a further substrate strip; the weak south pole on one face will "adhere" to the strong north pole on the juxtaposed face of the other substrate strip. In such an embodiment, the polarity identifying means would be juxtaposed to each other.

Furthermore, the strips may be placed opposed to each other whereby the strong north pole of one strip is aligned with the strong south pole of a further strip and the weaker poles of the strips are outwardly facing to receive the magnetic character units and the display surface.

Still further, the strips may be juxtaposed in a relationship such that a weak south pole and a weak north pole are aligned to each other with the strong south and north pole on the respective strips outwardly facing for juxtaposition to the magnetic units and the display surface. Thus, as may be seen, any combination of the strong and weak poles may be employed depending on the circumstances and results desired — i.e. if a strong force is desired between the display surface and the substrate strip, the strong poles are juxtaposed thereto.

Even further, the magnetic substrate strips may be placed in a side by side relationship such that no repulsive forces are encountered. Still further, using the above embodiment, when one magnetic strip is placed on a display surface of a ferromagnetic material, a further magnetic strip may be abutted thereto in an end to end relationship without experiencing any mutually repelling forces.

It will be understood that the above embodiments have been discussed with respect to one or a pair of magnetic strips; any number of such strips may be employed.

According to one aspect of the present invention, the display device also includes a plurality of magnetic display units adapted to act in cooperation with the magnetic substrate strips. In one embodiment, the magnetic units may be very similar to the aforedescribed substrate strips in that they comprise strips of magnetic material having alternating lines of parallel spaced apart northsouth polarity. As such, the magnetic unit may have one pair of opposed poles; alternatively, any number of spaced apart poles may be employed with the spacing being generally equivalent to the spacing of the poles of the substrate strips. Likewise, the material forming the magnetic display units may be any suitable and which is capable of exhibiting permanent magnetic properties — i.e., steel, iron, various resins, etc. Also, the display units may include polarity identifying means similar to those aforementioned with respect to the substrate strips and may be of a material forming a "flexible" unit.

The magnetic display units are adapted to display the desired information and to this end, the magnetic units may include a surface adapted to accept markings thereon. Alternatively, adhesive means or other means may be provided to place the markings on the magnetic units. Still further the magnetic display units may comprise "double" display units in that they include a pair of display units in a back to back relationship to each other with each face carrying a character or marking means thereon. Still further, the magnetic display units may carry further means for accepting the desired indicia.

The magnetic display units need not be identical to the substrate strips and thus, may include ceramic magnets or the like. Also, as aforementioned, the alternating magnetic lines are spaced apart and any one display unit may include a plurality of pairs of spaced apart magnetic lines.

With the display device of the present invention, the substrate strips may be placed on the display board or surface and adjustably moved with respect thereto since the display surface is not of a permanent magnetic nature. The display units are then held in an aligned manner by the magnetic forces of attraction and may be placed and slid along the substrate strips and easily removed.

Having thus generally described the invention, reference will be made to the accompanying drawings illustrating various embodiments thereof and in which:

FIG. 1 is a perspective view of a magnetic strip according to the present invention;

FIG. 2 is an end view of the strip of FIG. 1;

FIG. 5 is a perspective view of an alternate arrangement similar to FIG. 4;

FIG. 5A is a section taken along the line 5—5 of FIG. 5;

Figure 3C:
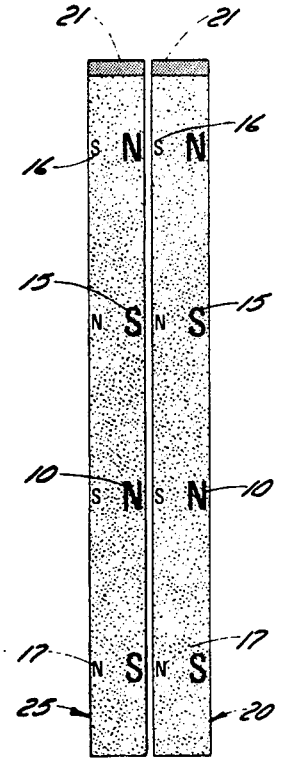
FIGS. 3B and 3C are similar views to that of FIG. 3A but showing different arrangements of the magnetic strips of the present invention.

Referring now to the drawings, and in specific FIG. 1, there is illustrated a flexible one-piece integral permanent magnetic substrate strip designated by reference numeral 20, which may be of a suitable material such as iron, steel, various resins, etc. having a pair of relatively strong north poles 10, and a pair of relatively strong south poles 15, running longitudinally in a spaced apart parallel manner along one face 11 of the magnetic substrate strip 20. Each of these poles is separated from an adjacent pole of opposite polarity by a substantially equal distance. Each north pole 10 has, on the opposed side 13 of the magnetic substrate strip, a corresponding weaker south pole 16, and conversely, each strong south pole 15 has a corresponding weaker north pole 17 on the opposed side. Each of the weak poles are substantially parallel and extend longitudinally in the same direction as the stronger poles. There are also provided for, in the present invention, means for identifying one of the strong poles on the edge of the magnetic substrate strip, which in the illustrated embodiment, comprises a color code 21 painted on the plastic surface identifying the edge proximate the strong north pole. The magnetic strip may be of any desired size and shape, although generally rectangular shapes are preferred for most usages. Although the magnetic strip as shown in FIGS. 1 and 2 consists of a pair of opposed poles, it may alternatively consist of a single set of opposed poles or a plurality of opposed poles. It is also within the scope of the present invention that each set of opposed poles may be separated by some suitable identifying means, if desired — i.e. a ridge at the time formed within the material. As will be seen from the drawings, each relatively strong pole is represented by characters (N,S) with each relatively weak pole represented by a smaller character (n,s). It will be understood that the terms "relatively weak" and "relatively strong" describe the relative strengths of their respective poles; the absolute values may be any suitable.

Figure 3B:
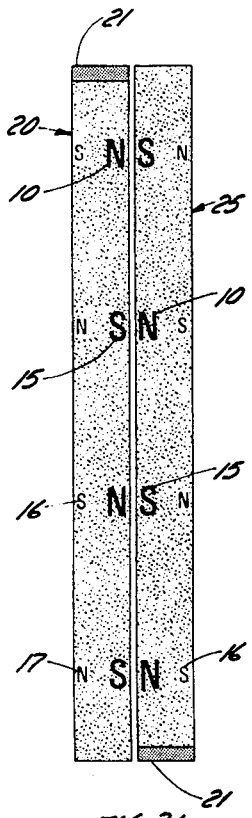
Figure 3A:
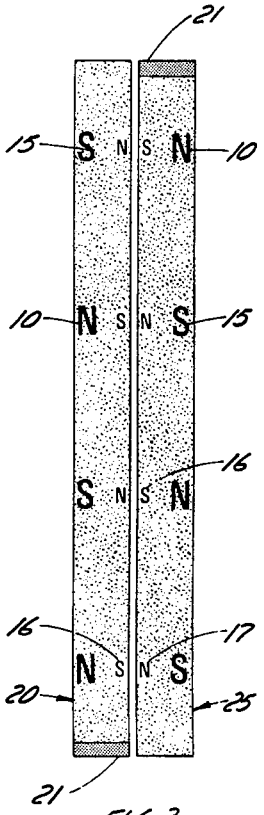
FIG. 3A is an end view of a pair of magnetic strips of the present invention arranged in one manner.

Referring now to FIGS. 3A, 3B and 3C, there is illustrated various arrangements of the magnetic substrate strips of the present invention as they may be placed on a display board (not shown). As illustrated in these Figures, a pair of magnetic strips designated by reference numerals 20 and 25 may be arranged whereby, as per FIG. 3A, the relatively strong poles (10, 15) of each strip face outwardly with the relatively weak poles (16, 17) being juxtaposed to each other. In this manner, each of the polarity identifying means 21 are located at opposed edges of the magnetic substrate strips. In this embodiment, the faces of the substrate strips having the relatively strong polarity are available for juxtaposition to the display board and further magnetic units as will be discussed in greater detail hereinafter. In other words, the pair of substrate strips 20 and 25 are held together by relatively weak magnetic forces.

An alternate arrangement is illustrated in FIG. 3B in which the faces having the relatively strong poles (10, 15) are juxtaposed together. As may be seen, a relatively strong attractive force exists between the magnetic substrate strips with a relatively weak magnetic force holding the substrate strips to a display board and further display units (not shown). In this embodiment, the polarity identifying means 21 are also at opposed edges.

In FIG. 3C, a still further arrangement is illustrated wherein the polarity identifying means 21 of magnetic substrate strips 20 and 25 are at adjacent edges. In this embodiment, the relatively weak poles (16, 17) of substrate strip 20 are juxtaposed to the relatively strong poles (10, 15) of substrate strip 25. Thus, if substrate strip 20 is placed on a suitable display board or surface, the strong poles thereof will hold the same thereto.

Figure 4:
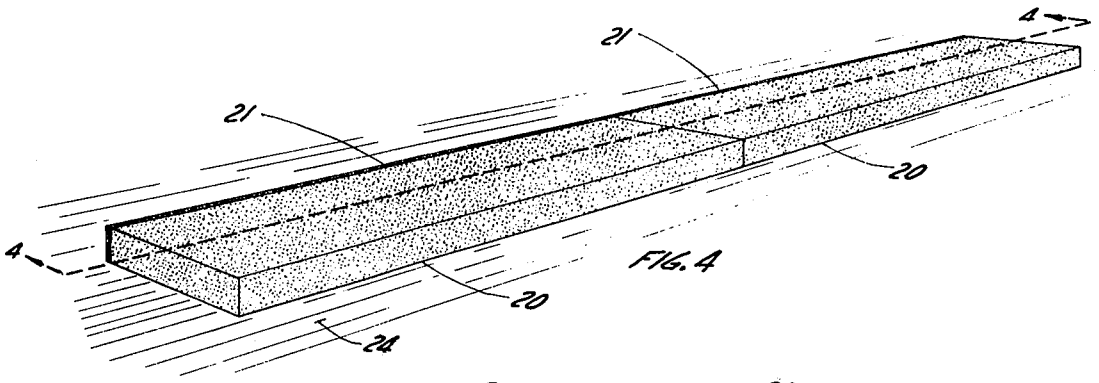
FIG. 4 is a perspective view of a pair of magnetic strips of the present invention aligned in an end to end relationship.
Figure 4A:
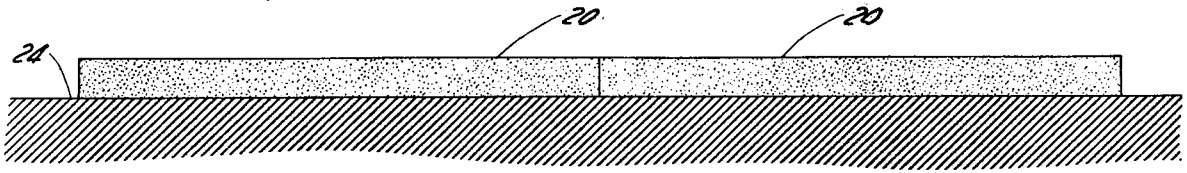
FIG. 4A is a section taken along the line 4—4 of FIG. 4.

In FIGS. 4 and 4A, there is illustrated an arrangement of the magnetic substrate strips in an abutted end to end relationship, as they may be located and placed on a display board or surface, such as is made of steel or other suitable ferromagnetic material. The display board, indicated generally be reference numeral 24, preferably has a substantially planar surface to permit the magnetic substrate strips 20 to lie in a substantially flat manner. As is illustrated in FIGS. 4 and 4A, abutted magnetic substrate strips do not repel each other when used on ferromagnetic surfaces, thus opening up many display possibilities.

In FIGS. 5 and 5A, a further arrangement of the magnetic substrate strips according to the present invention is illustrated, in which the alignment of the strong poles is illustrated in FIG. 5A. Similar reference numerals identifying similar parts to those previously described are employed; in this case, the display surface again is of a ferromagnetic material, and the use of the substrate strips of the present invention permits butted magnets which do not repel each other when used on such surfaces.

Figure 6:
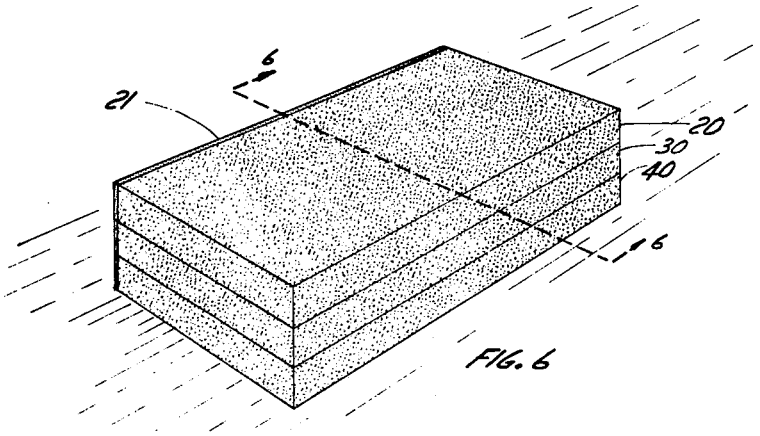
FIG. 6 is a perspective view of a plurality of magnetic strips placed on top of one another.
Figure 7:
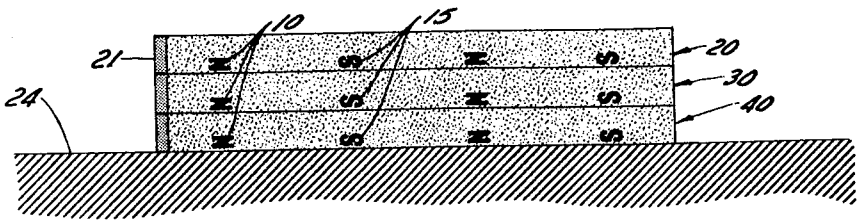
FIG. 7 is a section taken along the line 6—6 of FIG. 6.

In FIGS. 6 and 7, there is illustrated, again according to the present invention, how a plurality of magnetic substrate strips indicated generally by reference numerals 20, 30 and 40, may be placed on top of one another or in juxtaposition with each other, with the color-coded edges always being placed in the same relative position so that a strong north pole is always aligned with a weak south pole. This permits symmetrical stacking of a plurality of magnetic substrate strips of the present invention on a ferromagnetic surface 24 for display or stacking purposes.

Figure 8:
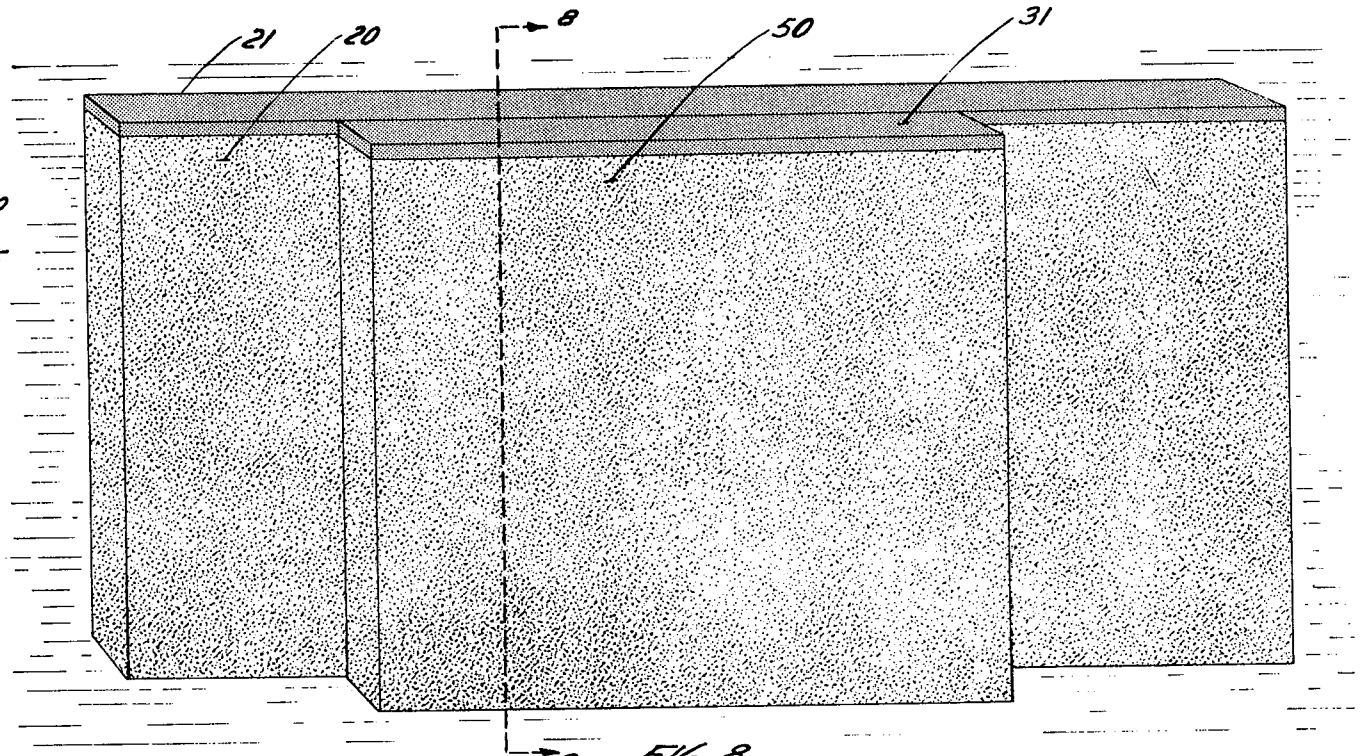
FIG. 8 is a perspective view of a magnetic assembly employing a pair of magnetic strips of the present invention.
Figure 9:
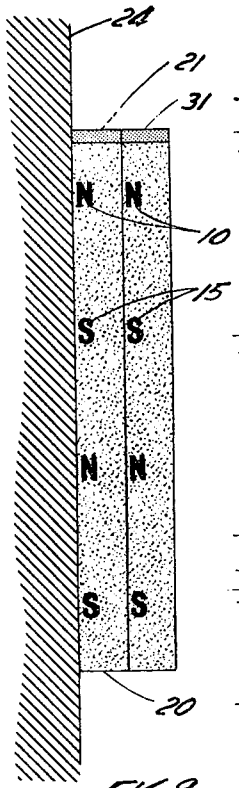
FIG. 9 is a section taken along the line 8—8 of FIG. 8.

Referring now to FIGS. 8 and 9, these drawings illustrate the magnetic alignment in a strong/weak fashion wherein magnetic display units are employed on top of the magnetic substrate strips. More specifically, a magnetic substrate strip 20 is placed on a suitable ferromagnetic surface 24 and a magnetic display unit 50 is placed on top thereof with the polarity identifying means 31 of display unit 50 being juxtaposed to the polarity identifying means of the substrate strip 20. In this manner, display unit 50 may be moved along the track formed by substrate strip 20 and will always be aligned with the same due to the magnetic forces.

Figure 10:
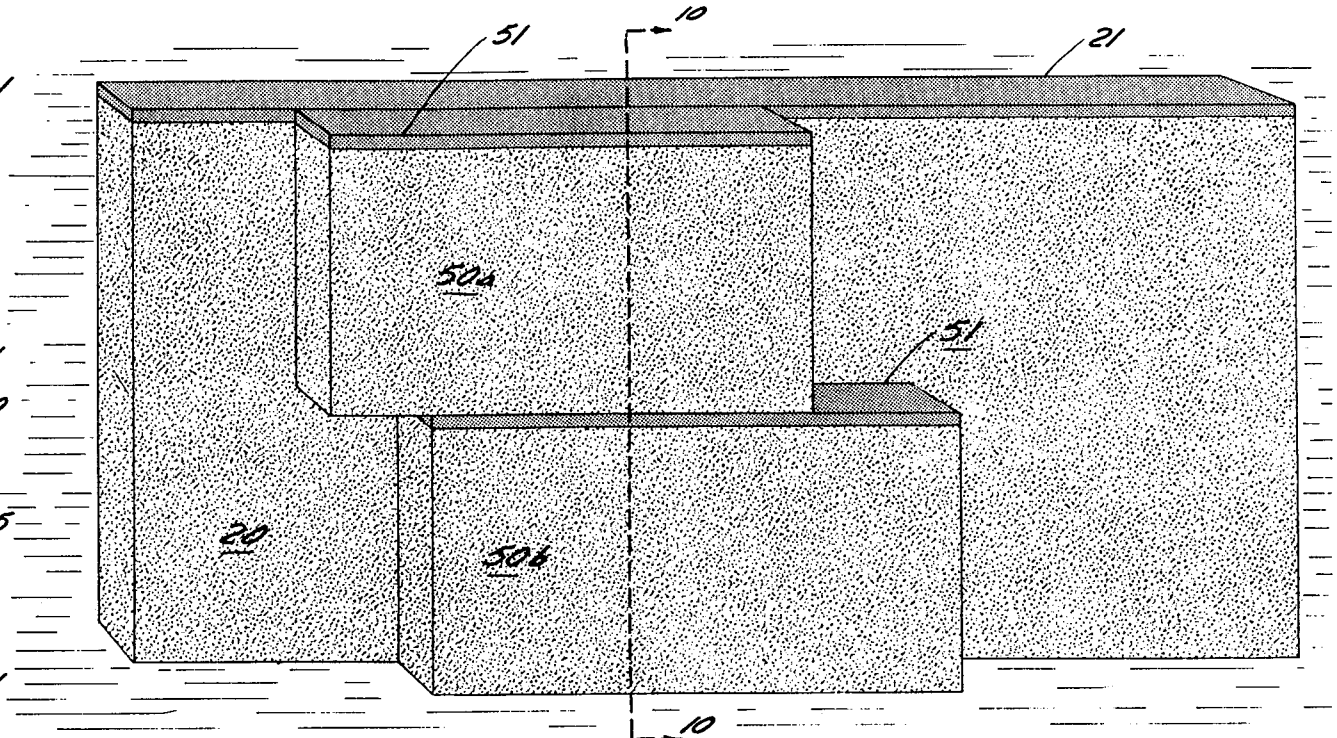
FIG. 10 is a view showing an alternate embodiment of the present invention utilizing a plurality of magnetic strips.
Figure 11:
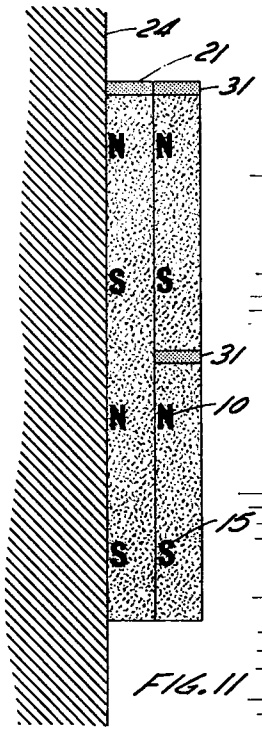
FIG. 11 is a section taken along the line 10—10 of FIG. 10.

In FIGS. 10 and 11, a similar arrangement to that described with respect to FIGS. 8 and 9 is illustrated, but in this case, a pair of smaller magnetic units 50*a* and 50*b* are employed on substrate strip 20 to form and permit aligned motion in a "double track" manner. Thus, by arranging the magnetic display units to have the polar arrangement illustrated in FIG. 11, each of the units 50*a* and 50*b* may be moved as desired independently along substrate strip 20.

Figure 12:
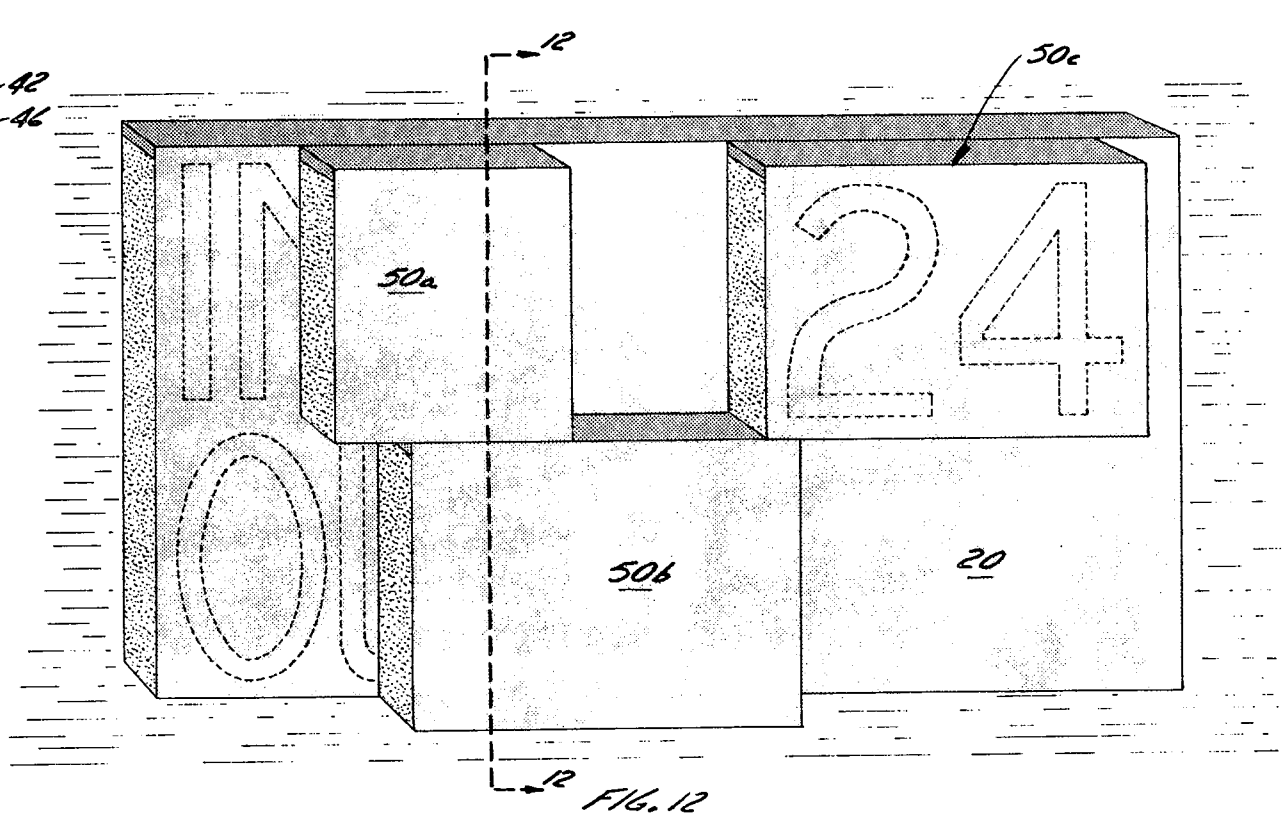
FIG. 12 is a view similar to that of FIG. 10 but showing a different arrangement.
Figure 13:
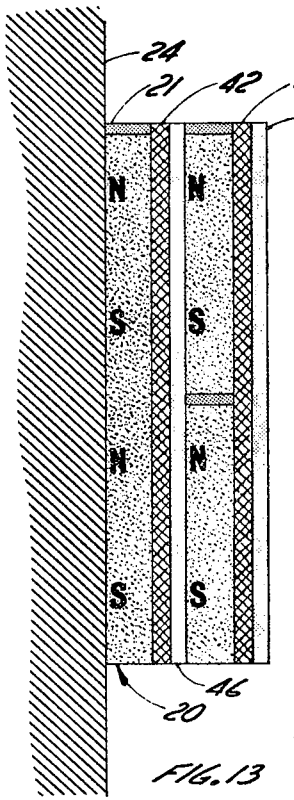
FIG. 13 is a section taken along the line 12—12 of FIG. 12.

FIGS. 12 and 13 illustrate a similar version to that described with respect to FIGS. 11 and 12, but in this case, the magnetic strips have a different construction. More specifically, as illustrated in FIG. 13, the magnetic substrate strip 20 and display units 50*a*, 50*b* and 50*c* described with respect to the previous Figures include an adhesive layer of any suitable adhesive indicated generally by reference numeral 42, which secures to the front, a non-magnetic layer such as may be provided by a plastic material, and which is indicated generally by reference numeral 46. As shown in FIG. 12, the plastic materials may be color-coded, or carry other indicia or messages, for display purposes. Thus, the arrangement of FIGS. 12 and 13 permits displaying information while at the same time, providing for convering the information as desired, exposing selected information as desired, adding information by virtue of adding one or more magnetic display units as desired, and moving information on a display board. The arrangement of FIGS. 12 and 13, as with FIGS. 10 and 11, is preferably mounted on a suitable steel or other ferromagnetic surface 24. Further, as will be noted from this arrangement as illustrated in FIGS. 12 and 13, the arrangement permits aligned motion on the "double" track basis.

Figures 14, 15, 16, 17:
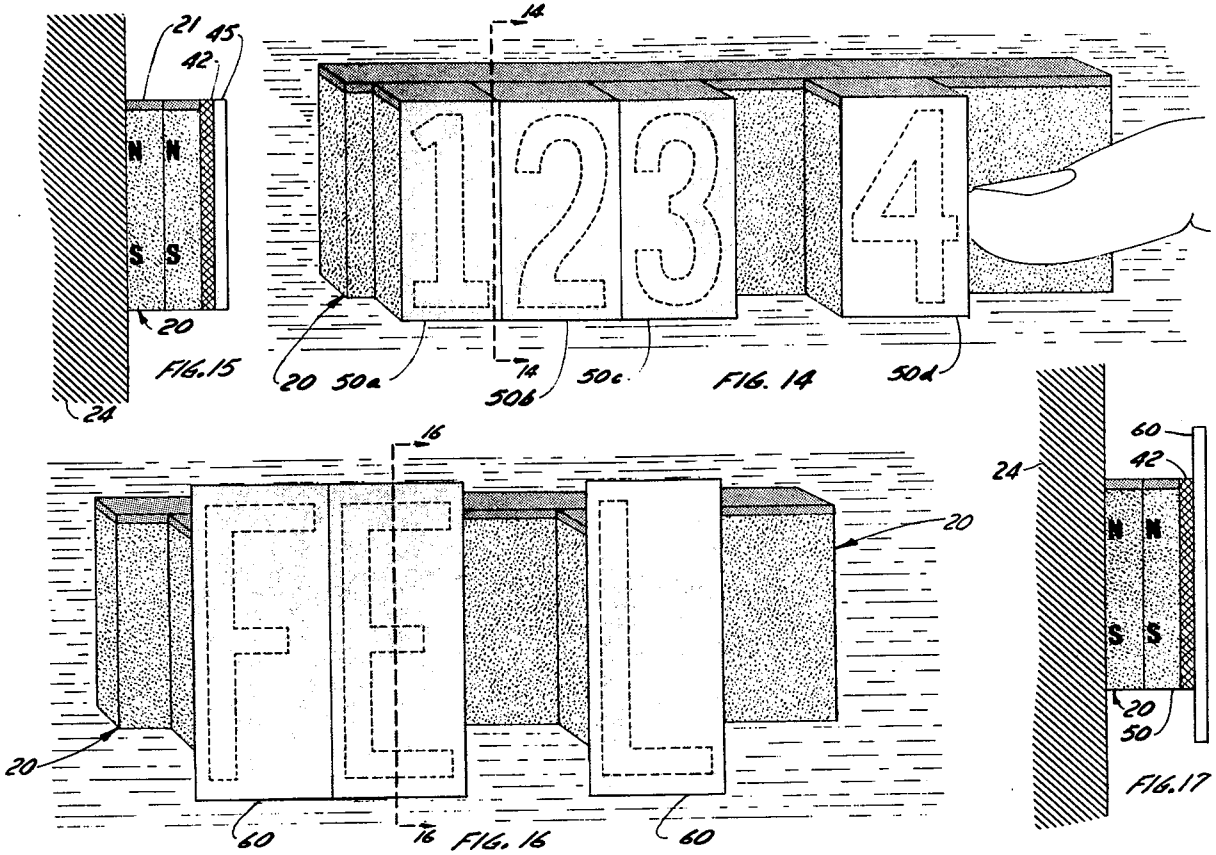
FIG. 14 shows an alternate embodiment of the present invention using the "modular" concept.
FIG. 15 is a section taken along the line 14—14 of FIG. 14.
FIG. 16 is a view similar to that of FIG. 14 showing a still further embodiment.
FIG. 17 is a section taken along the line 16—16 of FIG. 16.

Referring now to FIGS. 14 and 15, there is illustrated a further embodiment of the present invention which provides for aligned motion using a "modular" build up arrangement. Thus, in this embodiment, there is provided a first magnetic substrate strip 20 of the type illustrated in FIGS. 1 et seq., and a plurality of further magnetic modular or display units 50*a*, 50*b*. These modular units 50 are similar in construction to those indicated by reference numerals 50*a* and 50*b* in FIG. 12. The magnetic substrate strip 20 is suitably mounted on a display surface 24.

By using the modular build up arrangement as illustrated in FIGS. 14 and 15, each modular unit 50 may be moved as desired as indicated by the arrows in this Figure and they may be interchanged to illustrate various types of messages or displays as desired.

Referring now to FIGS. 16 and 17, there is illustrated a further arrangement utilizing generally the same type of magnetic strips illustrated in FIGS. 14 and 15. In this embodiment, however, a different front layer 60, carrying indicia or other symbols or the like, is mounted by means of the adhesive 42 to the modular magnetic display units indicated generally by reference numeral 50, thus giving a different variation from that illustrated in FIGS. 14 and 15.

Figure 18:
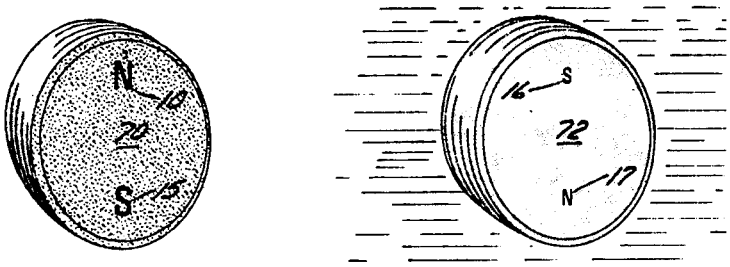
FIG. 18 shows the front and back views of a ceramic magnet unit for use in the present invention.
Figure 19:
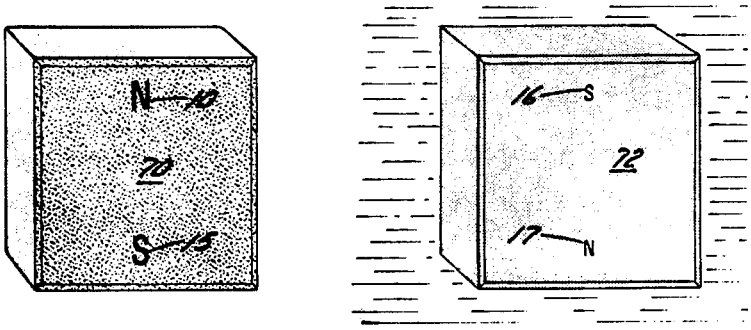
FIG. 19 is a view similar to FIG. 18 but with a different type of ceramic magnetic unit.
Figure 20:
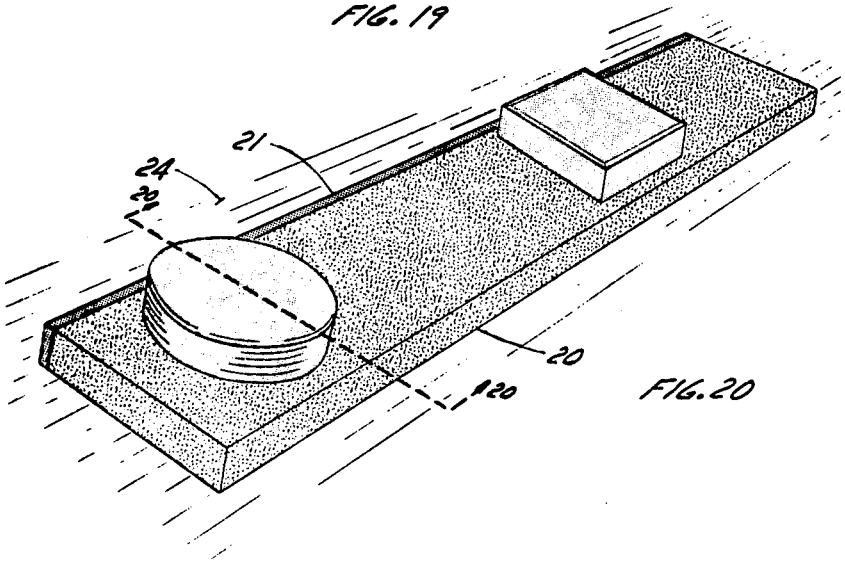
FIG. 20 is a perspective view of a further arrangement of the ceramic units of FIGS. 18 and 19 on a magnetic strip.
Figure 21:
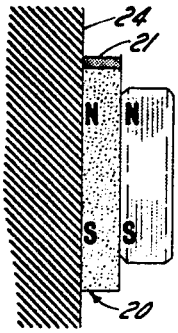
FIG. 21 is a section taken along the line 20—20 of FIG. 20.

Referring now to FIGS. 18 and 19, there is shown the front and rear views of ceramic magnets of different configurations, in which the front of the ceramic magnets indicated generally by reference numeral 70 has the strong north and south poles, while the back portion indicated generally by reference numeral 72 has the weak south and north poles. Such ceramic magnets, for use within the present invention, may have any desired shape and/or size. In use of the magnets of FIGS. 18 and 19, as illustrated in FIGS. 20 and 21, such magnets may be mounted on a magnetic substrate strip of the type previously described and as indicated by reference numeral 20. These ceramic magnets may carry indicia or other suitable advertising/display material, and as shown in FIGS. 20 and 21, they may be moved to permit aligned motion on the substrate strip 20. In turn, the substrate strip 20 is mounted on a display surface 24.

Figure 22:
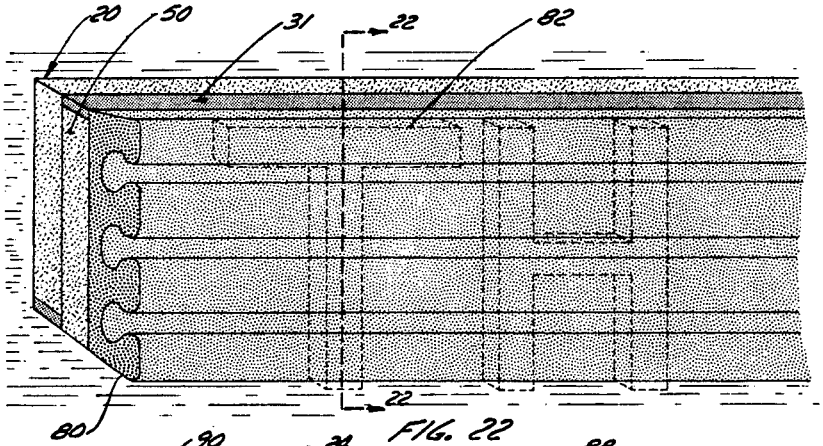
FIG. 22 is a perspective view of an alternate embodiment of the present invention.
Figure 23:
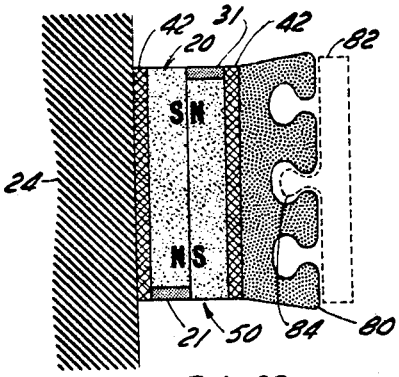
FIG. 23 is a section taken along the line 22—22 of FIG. 22.

In FIGS. 22 and 23, a modification of the present invention is illustrated in which a substrate strip 20 includes a layer of adhesive 42 with the strong north and strong south poles being mounted as indicated. Preferably, in this type of embodiment, the magnetic substrate strip 20, is adhesively secured to a suitable substrate which may be of a ferromagnetic or non-magnetic material by virtue of the adhesive 42; the other modular magnetic unit indicated generally by reference numeral 50 is provided with an adhesive 42 on its outer surface securing thereto a further display means 80. This further display surface may have various different configurations and shapes; a preferred one is illustrated in which the display means 80 comprises a rubber or like backing material grooved or otherwise recessed to receive characters, or other display or indicia (such as letters as indicated by the dotted lines and by reference numeral 82) which include a projecting mating member 84 adapted to fit within the groove.

Figure 24:
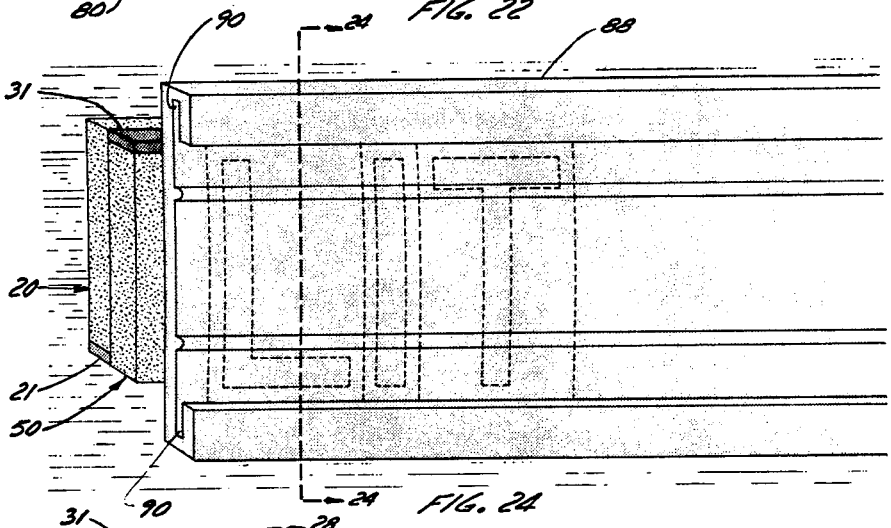
FIG. 24 is a perspective view of a still alternate embodiment of the present invention.
Figure 25:
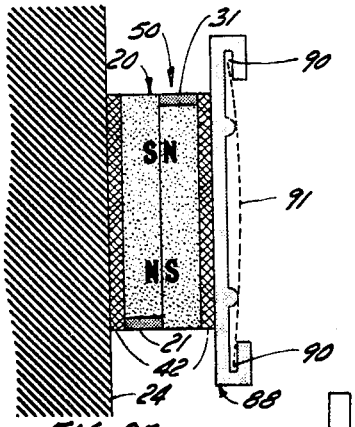
FIG. 25 is a section taken along the line 24—24 of FIG. 24.

A modification of the above arrangement is illustrated in FIGS. 24 and 25, in which there is secured to the outer surface of modular magnetic unit 50, a different type of display means which is indicated generally by reference numeral 88. In this case, the display unit forms a supporting surface adapted to receive lettering or other indicia — the display means has a generally planar configuration with a pair of opposed "U-shaped" channels 90 adapted to receive upper and lower portions of display cards 91, in the manner illustrated by the dotted lines in FIGS. 24 and 25. This particular arrangement is highly advantageous for name channel applications, or other similar usages.

Figure 27:
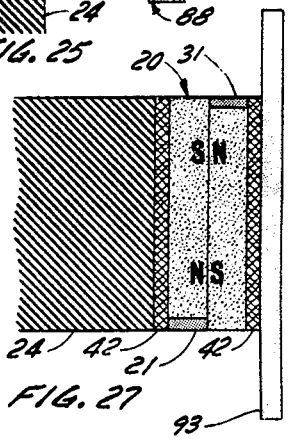
FIG. 27 is a section taken along the line 26—26 of FIG. 26.
Figure 26:
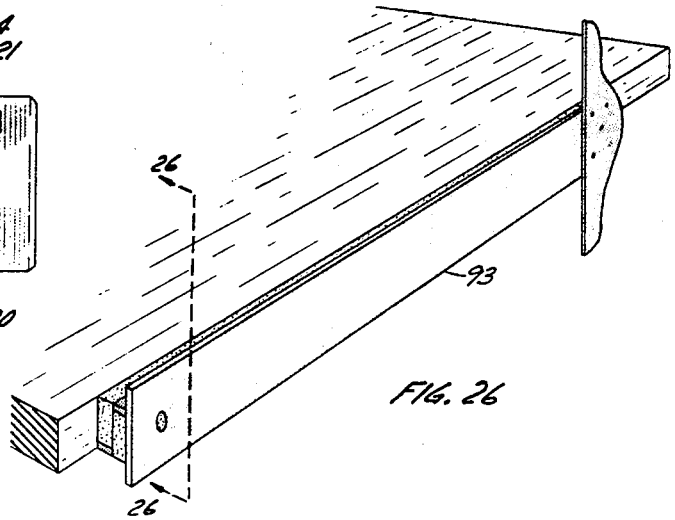
FIG. 26 is a perspective view of a further embodiment of the present invention.

Referring now to FIGS. 26 and 27, a further embodiment of the present invention is illustrated in which again, a substrate strip and display unit are secured to a suitable display board 24. Similar reference numerals are used to designate similar parts to those parts described with respect to previous FIGS. In this embodiment, the display unit is provided with a layer of adhesive 42, to which is secured any desired item such as may be used on occasion for various purposes. A T square 93 is illustrated in FIGS. 26 and 27 as being fixedly secured to the display unit and, when it is desired to use the same, the display unit is merely separated from the magnetic substrate strip whereby the T square may be used and then returned for storage purposes. It will be appreciated that within the context of this embodiment, many other articles may be similarly mounted, where it is required to display or store such articles when not in use.

Figure 28:
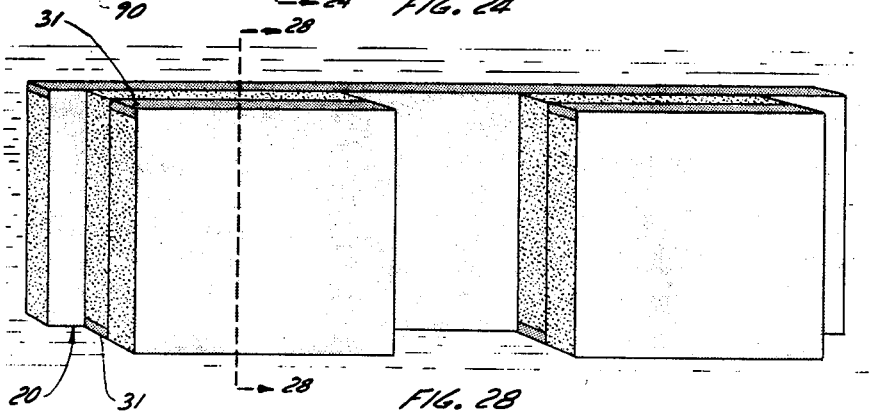
FIG. 28 is a perspective view of a further embodiment of the present invention.
Figure 29:
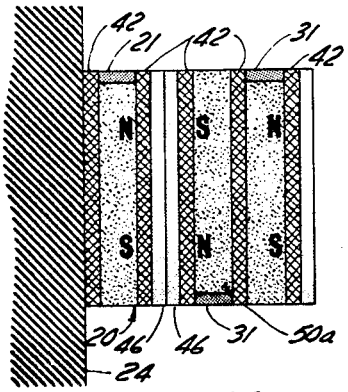
FIG. 29 is a section taken along the line 28—28 of FIG. 28.

Referring now to FIGS. 28 and 29, a modified arrangement showing a weak-to-weak polar relationship of a pair of magnetic display units is illustrated. Specifically, a display board surface, which may be ferromagnetic or non-magnetic, indicated generally by reference numeral 24, is employed to which there is secured, by means of adhesive 42, a magnetic substrate strip indicated generally by reference numeral 20. In turn, there may also be included, if desired, an outer covering layer such as the plastic layers 46, to the other face thereof. A first modular display unit 50*a*, is provided which again may be provided with an outer plastic layer 46 secured by means of adhesive 42. Thus magnetic substrate strip 20 and unit 50*a* are separable. Secured to the unit 50*a*, by means of an adhesive layer 42, is a further magnetic display unit 50*b*, which may also include a surface of a plastic layer 46 or the like, secured by means of an adhesive. The units 50*a* and 50*b* are thus secured to each other and these may or may not be of the same size and shape as the magnetic substrate strip 20. As illustrated in FIG. 28, the modular concept has been employed for units 50*a* and 50*b*. FIG. 28 further illustrates an embodiment of the invention wherein the units 50*a* and 50*b* may be changed whereby the back face may become the front face by reversing the modular units 50*a* and/or 50*b* as desired. By virtue of the arrangement illustrated in FIGS. 28 and 29, there are provided double sided magnetic units positioned in such a manner that the color-coded edges 31 are never butted, thus ensuring correct placement of either face for double magnetic alignment for display or other similar purposes.

It will be understood that various changes and modifications may be made to the above-described embodiments without departing from the spirit and scope of the invention which is not limited to these embodiments, but rather by the claims appended hereto.

We claim:

1. A display device comprising a display board having an outwardly facing surface, said board being of a ferromagnetic material and having non-permanent magnetic properties, at least one flexible substrate strip, said substrate strip having permanent magnetic properties comprising at least one pair of parallel spaced apart north and south magnetic poles extending in one direction thereof, and at least one display unit having permanent magnetic properties comprising at least one pair of spaced apart north and south magnetic poles, said poles of said display unit being spaced apart by a distance equal to a multiple of the spacing of the north and south magnetic poles of the magnetic substrate strip.

2. The device of claim 1 comprising a plurality of said magnetic substrate strips, each of said substrate strips having at least a pair of spaced apart north and south magnetic poles.

3. The device of claim 2 wherein each of said substrate strips comprises a plurality of pairs of equidistantly spaced apart north and south magnetic poles.

4. The device of claim 1 wherein said substrate strip comprises a plurality of parallel equally spaced apart alternating north and south magnetic poles.

5. The device of claim 4 wherein said substrate strip comprises a magnetic portion having said parallel spaced apart north and south magnetic poles and a surface portion of a plastics material.

6. The device of claim 4 comprising a magnetic portion formed of said plurality of parallel spaced apart alternating north and south magnetic poles and a surface portion of a plastics material, each pair of north and south magnetic poles being adjoined to an adjacent pair of north and south magnetic poles by said plastics material.

7. The device of claim 6 wherein said plastics material is adhesively held to said magnetic portion.

8. The device of claim 1 including polarity identifying means on said magnetic substrate strip, said polarity identifying means being adapted to identify the polarity of one of said north and south magnetic poles.

9. The device of claim 8 wherein said polarity identifying means comprises means on one edge of said magnetic substrate strips.

10. The device of claim 9 wherein said means on the edge of said substrate strip comprises a color-coded portion thereon.

11. A display device comprising a display board having an outwardly facing surface, said being of a ferromagnetic material and having non-permanent magnetic properties, at least one substrate strip, said substrate strip having permanent magnetic properties comprising at least one pair of parallel spaced apart north and south magnetic poles extending in one direction thereof, and at least one display unit having permanent magnetic properties comprising at least one pair of spaced apart north and south magnetic poles, said poles of said display unit being spaced apart by a distance equal to a multiple of the spacing of said north and south magnetic poles of the magnetic substrate strip, said substrate strip comprising a strip of magnetic material having a pair of opposed major faces, one of said major faces having relatively strong magnetic properties comprising at least a pair of parallel spaced apart north and south magnetic poles, the other of said major faces having relatively weak magnetic properties comprising at least a pair of parallel spaced apart north and south magnetic poles, said strong north magnetic pole on the one major face being located substantially opposed to the relatively weak south magnetic pole on the other major face, said relatively strong south magnetic pole on the one major face being substantially opposed to the relatively weak north magnetic pole on the other major face.

12. The device of claim 1 including a plurality of said magnetic display units, each of said magnetic display units having at least one indicia on a surface thereof.

13. The device of claim 12 wherein each of said magnetic display units comprises a magnetic portion and a further portion of a plastics material, said further portion being secured to said magnetic portion by adhesive means, said further portion carrying at least one character thereon.

14. The device of claim 11 including a plurality of said display units, each of said display units having a pair of opposed major faces with one of said major faces having relatively strong magnetic properties comprising at least a pair of spaced apart north and south magnetic poles, the other of said major faces having relatively weak magnetic properties comprising a pair of spaced apart noth and south magnetic poles, the strong north magnetic pole being substantially opposed to the weak south magnetic pole, and the strong south pole being substantially opposed to the weak north pole.

15. The device of claim 14 including a plurality of pairs of said magnetic display units with the outwardly facing major faces of said pairs of display units each carrying at least one indicia thereon.

16. The device of claim 15 including polarity identifying means associated with each of said display units.

17. The device of claim 14 wherein said major face of said magnetic substrate strip having the relatively strong north and south magnetic poles is juxtaposed to the outwardly facing surface of the display board, the major face of the substrate strip having the relatively weak north and south magnetic poles being juxtaposed to the major face of the magnetic unit having the relatively weak north and south magnetic poles.

18. The device of claim 14 wherein the major face of the magnetic substrate strip having the relatively weak north and south magnetic poles is juxtaposed to the surface of the display board, and the major face of the magnetic display unit having the relatively strong north and south magnetic poles is juxtaposed to the major face of the substrate strip having the relatively strong north and south magnetic poles.

19. The device of claim 14 wherein the major face of the magnetic display unit having the relatively weak north and south magnetic poles is juxtaposed to the major face of the magnetic substrate strip having the relatively strong north and south magnetic poles.

20. The device of claim 14 wherein the major face of the magnetic display unit having the relatively strong north and south magnetic poles is juxtaposed to the major face of the magnetic substrate strip having the relatively weak north and south magnetic poles.

21. The device of claim 1 wherein each of said magnetic substrate strips is a longitudinally extending strip of a flexible magnetic material.

22. The device of claim 11 wherein said substrate strip carries on one of said major faces a plurality of indicia, said display unit being adapted to selectively cover at least some of said indicia as desired.

23. The device of claim 11 wherein each of said substrate strips and display units comprise one pair of spaced apart north and south magnetic poles.

* * * * *